US011385582B2

(12) United States Patent
Sakamoto et al.

(10) Patent No.: US 11,385,582 B2
(45) Date of Patent: Jul. 12, 2022

(54) IMAGE FORMING DEVICE

(71) Applicant: FUJIFILM Business Innovation Corp., Tokyo (JP)

(72) Inventors: Tokuya Sakamoto, Ebina (JP); Takayuki Yamashita, Ebina (JP); Tetsuro Kodera, Ebina (JP); Kosuke Yamada, Ebina (JP); Yoshiki Shimodaira, Ebina (JP); Masato Yamashita, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/334,140

(22) Filed: May 28, 2021

(65) Prior Publication Data

US 2021/0286305 A1 Sep. 16, 2021

Related U.S. Application Data

(63) Continuation of application No. PCT/JP2019/030789, filed on Aug. 5, 2019.

(30) Foreign Application Priority Data

Feb. 20, 2019 (JP) ..... JP2019-028810

(51) Int. Cl.
*G03G 15/23* (2006.01)
*G03G 15/20* (2006.01)
*G03G 15/00* (2006.01)

(52) U.S. Cl.
CPC ..... *G03G 15/235* (2013.01); *G03G 15/20* (2013.01); *G03G 15/2007* (2013.01);
(Continued)

(58) Field of Classification Search
CPC ..... G03G 15/5054; G03G 15/602; G03G 15/607; G03G 15/2039; G03G 15/2007;
(Continued)

(56) References Cited

U.S. PATENT DOCUMENTS 5,495,324 A 2/1996 Kopp
5,572,290 A 11/1996 Ueno et al.
(Continued)

FOREIGN PATENT DOCUMENTS

JP H07-044043 A 2/1995
JP H08-050429 A 2/1996
(Continued)

OTHER PUBLICATIONS

Machine Translation of JP 2007-017495. Jan. 25, 2007. (Year: 2007).*
(Continued)

*Primary Examiner* — Carla J Therrien
(74) *Attorney, Agent, or Firm* — Oliff PLC

(57) ABSTRACT

An image forming device includes a transfer unit that transfers a toner image onto a recording medium that has first and second surfaces and is conveyed in a conveyance direction; a main heating unit arranged downstream of the transfer unit in the conveyance direction, and which contacts and heats the recording medium and fixes the toner image onto the recording medium; a reversing unit that reverses front and back of the recording medium having a first toner image fixed onto the first surface; and a preheating unit arranged between the transfer and main heating units in the conveyance direction and that heats the recording medium having a second toner image transferred onto the second surface. The preheating unit heats the recording medium so that a temperature of the first surface is lower than a
(Continued)

softening point of a toner before the recording medium is heated by the main heating unit.

8 Claims, 10 Drawing Sheets

(52) U.S. Cl.
CPC ..... *G03G 15/2021* (2013.01); *G03G 15/2039* (2013.01); *G03G 15/5054* (2013.01); *G03G 15/602* (2013.01); *G03G 15/607* (2013.01); *G03G 2215/1671* (2013.01)

(58) Field of Classification Search
CPC .. G03G 15/201; G03G 15/235; G03G 21/206; G03G 2215/1671; G03G 2215/2083; G03G 2221/1645
See application file for complete search history.

(56) References Cited

U.S. PATENT DOCUMENTS

| | | | | |
|---|---|---|---|---|
| 5,758,227 | A | 5/1998 | Kopp | |
| 6,430,381 | B1 | 8/2002 | Kopp | |
| 8,611,774 | B2 * | 12/2013 | Aslam | G03G 15/2007 399/67 |
| 2007/0281238 | A1 * | 12/2007 | Behnke | G03G 15/2007 430/124.1 |
| 2008/0181685 | A1 * | 7/2008 | Shimatsu | G03G 15/201 399/324 |
| 2008/0317528 | A1 | 12/2008 | Lee et al. | |
| 2012/0039643 | A1 * | 2/2012 | Chang | G03G 15/2021 399/320 |
| 2014/0205308 | A1 | 7/2014 | Kamoda et al. | |
| 2021/0286298 | A1 * | 9/2021 | Yamashita | G03G 15/20 |
| 2021/0286304 | A1 * | 9/2021 | Shimodaira | G03G 15/2053 |
| 2021/0294264 | A1 * | 9/2021 | Yamada | G03G 15/20 |
| 2021/0325803 | A1 * | 10/2021 | Yamashita | G03G 15/2064 |

FOREIGN PATENT DOCUMENTS

| | | | |
|---|---|---|---|
| JP | 2000-047503 | A | 2/2000 |
| JP | 2007-017495 | A | 1/2007 |
| JP | 2009-163065 | A | 7/2009 |
| JP | 2011-039148 | A | 2/2011 |
| JP | 2014-139619 | A | 7/2014 |

OTHER PUBLICATIONS

Machine Translation of JP 2011-039148. Feb. 24, 2011. (Year: 2011).*

Oct. 8, 2019 International Search Report issued in International Patent Application No. PCT/JP2019/030789.

Oct. 8, 2019 Written Opinion of the International Searching Authority issued in International Patent Application No. PCT/JP2019/030789.

* cited by examiner

FIG. 3

| | TEMPERATURE OF SECOND SURFACE [°C] | TEMPERATURE OF FIRST SURFACE [°C] | DIFFERENCE OF GLOSSINESS | EVALUATION |
|---|---|---|---|---|
| EXAMPLE 1 | 65 | 60 | 4 | GOOD |
| EXAMPLE 2 | 70 | 65 | 4 | GOOD |
| EXAMPLE 3 | 75 | 70 | 5 | GOOD |
| COMPARATIVE EXAMPLE 1 | 85 | 80 | 11 | POOR |
| COMPARATIVE EXAMPLE 2 | 95 | 90 | 13 | POOR |
| COMPARATIVE EXAMPLE 3 | 70 | 75 | 11 | POOR |

IMAGE FORMING DEVICE

CROSS REFERENCE TO RELATED APPLICATION

This is a continuation of International Application No. PCT/JP2019/030789 filed on Aug. 5, 2019, and claims priority from Japanese Patent Application No. 2019-28810 filed on Feb. 20, 2019.

BACKGROUND

Technical Field

The present invention relates to an image forming device.

Related Art

An electrophotographic system disclosed in JP-H08-50429 sets a printing speed used in a case where plural electrophotographic devices are connected to perform printing and a printing speed used in a case where plural electrophotographic devices are made independent of each other and printing is performed by separate electrophotographic devices, and includes a printing speed switching unit that switches between the printing speeds.

SUMMARY

In the related art, when forming a toner image on both surfaces of a recording medium, the toner image is first transferred onto a first surface of the recording medium. Next, a preheating unit heats the recording medium having the toner image transferred onto the first surface thereof. Further, a main heating unit comes into contact with the recording medium to heat the recording medium, and fixes the toner image onto the first surface of the recording medium heated by the preheating unit. Next, the toner image is transferred onto a second surface of the recording medium having the toner image fixed onto the first surface thereof. Next, the preheating unit heats the recording medium having the toner image transferred onto the second surface thereof. Further, the main heating unit comes into contact with the recording medium to heat the recording medium, and fixes the toner image onto the second surface of the recording medium heated by the preheating unit.

Here, since the preheating unit heats the recording medium having the toner image transferred onto the second surface thereof, a temperature of the first surface of the recording medium becomes equal to or higher than a softening point of a toner. Thereafter, when the toner image on the first surface is heated a second time by the main heating unit, glossiness of the toner image on the first surface becomes higher than glossiness of the toner image on the second surface. That is, a glossiness difference (=gloss difference) occurs between the toner image on the first surface and the toner image on the second surface.

Aspects of non-limiting embodiments of the present disclosure relate to reducing the difference between the glossiness of the toner image on the first surface and the glossiness of the toner image on the second surface, as compared with the case where, before the main heating unit heats the recording medium having the toner image transferred onto the second surface thereof, the temperature of the first surface of the recording medium is equal to or higher than the softening point of the toner since the recording medium having the toner image transferred onto the second surface thereof is heat by the preheating unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming device including: a transfer unit that transfers a toner image onto a recording medium being conveyed; a main heating unit that is arranged downstream of the transfer unit in a conveyance direction of the recording medium, comes into contact with the recording medium to heat the recording medium, and fixes the toner image onto the recording medium; a reversing unit that reverses front and back of the recording medium having a first toner image fixed onto a first surface of the recording medium by the main heating unit, and sends the recording medium to the transfer unit; and a preheating unit that is arranged between the transfer unit and the main heating unit in the conveyance direction of the recording medium and heats the recording medium having a second toner image transferred onto a second surface of the recording medium, wherein the preheating unit heats the recording medium so that a temperature of the first surface of the recording medium is lower than a softening point of a toner before the recording medium is heated by the main heating unit.

BRIEF DESCRIPTION OF DRAWINGS

Exemplary embodiment(s) of the present invention will be described in detail based on the following figures, wherein:

FIG. 3 is a table showing evaluation results of evaluating the image forming device according to the exemplary embodiment and an image forming device according to a comparative embodiment;

DETAILED DESCRIPTION

Figure 1:
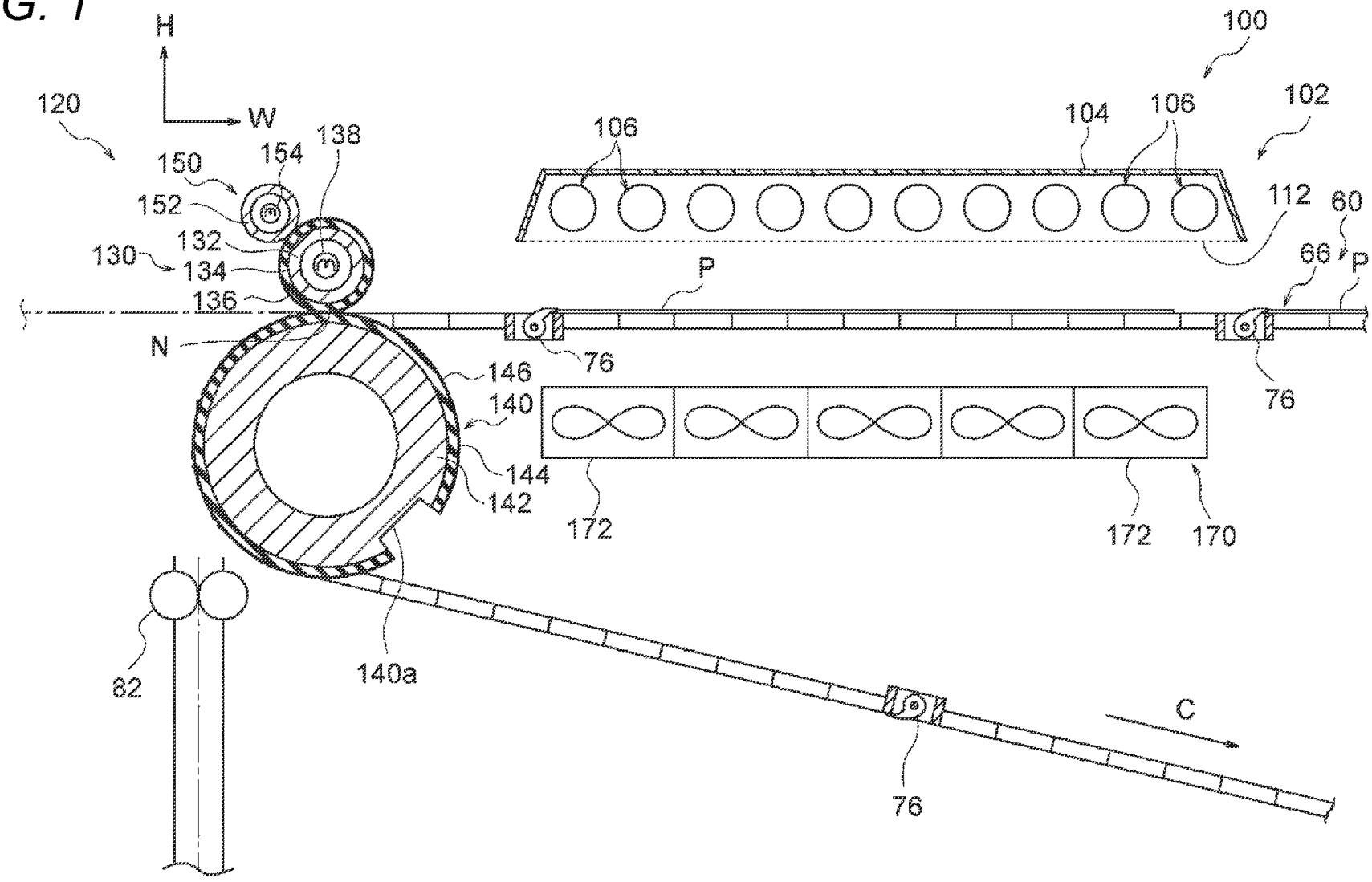
FIG. 1 is a configuration diagram illustrating a fixing device provided in an image forming device according to an exemplary embodiment.

An example of an image forming device according to an exemplary embodiment will be described with reference to FIGS. 1 to 10. In the drawings, an arrow H indicates a device vertical direction (perpendicular direction), an arrow W indicates a device width direction (horizontal direction), and an arrow D indicates a device depth direction (horizontal direction).

(Image Forming Device 10)

Figure 9:
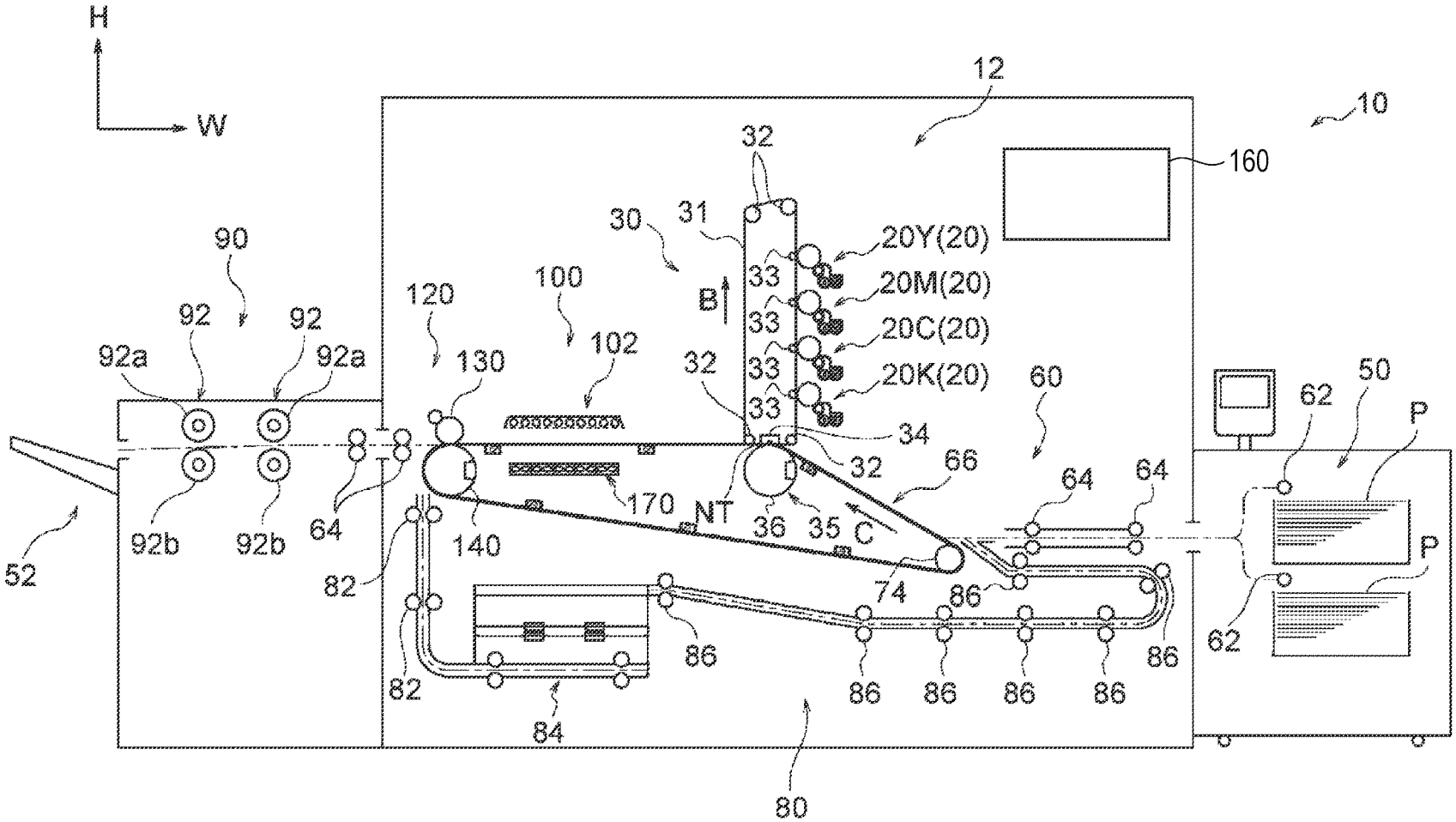
FIG. 9 is a configuration diagram illustrating the image forming device according to the exemplary embodiment.

An image forming device 10 according to the exemplary embodiment is an electrophotographic image forming device that forms a toner image on a sheet member P. As illustrated in FIG. 9, the image forming device 10 includes a control unit 160, an accommodating portion 50, a discharge portion 52, an image forming unit 12, a conveying mechanism 60, a reversing mechanism 80, a fixing device 100, and a cooling unit 90.

[Control Unit 160]

The control unit 160 is configured with a central processing unit (CPU), a read only memory (ROM), a random access memory (RAM), and a hard disk drive (HDD) (none is shown). The CPU executes a processing program. The ROM stores various programs, various tables, parameters, and the like. The RAM is used as a work area or the like when the CPU executes various programs.

[Accommodating Portion 50]

The accommodating portion 50 has a function of accommodating the sheet member P as a recording medium. The image forming device 10 may include plural (for example, two) accommodating portions 50, and may selectively send out the sheet member P from the plural accommodating portions 50.

[Discharge Portion 52]

The discharge portion 52 is a portion from which the sheet member P on which a toner image is formed is discharged. Specifically, after the toner image is fixed by the fixing device 100, the sheet member P cooled by the cooling unit 90 is discharged to the discharge portion 52.

[Image Forming Unit 12]

The image forming unit 12 has a function of forming a toner image on the sheet member P by an electrophotographic method. Specifically, the image forming unit 12 includes a toner image forming unit 20 that forms a toner image, and a transfer device 30 that transfers the toner image formed by the toner image forming unit 20 to the sheet member P.

Plural toner image forming units 20 are provided so as to form a toner image for each color. The image forming device 10 includes toner image forming units 20 of a total of four colors of yellow (Y), magenta (M), cyan (C), and black (K). The (Y), (M), (C), and (K) shown in FIG. 9 show constituent portions corresponding to the respective colors.

-Toner Image Forming Unit 20-

Figure 8:
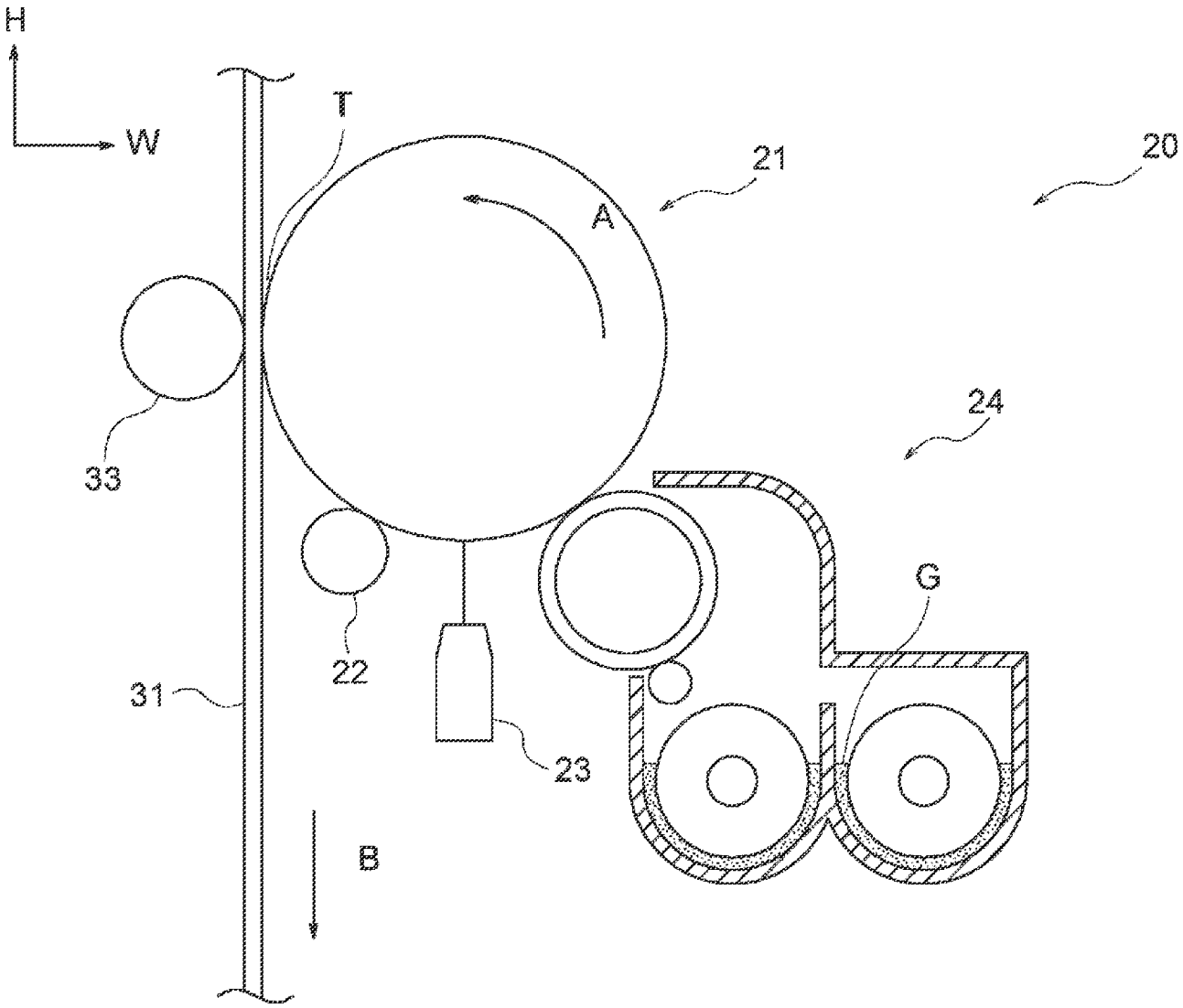
FIG. 8 is a configuration diagram illustrating a toner image forming unit provided in the image forming device according to the exemplary embodiment.

The toner image forming units 20 of these colors have basically the same configuration except for toner to be used. Specifically, as illustrated in FIG. 8, the toner image forming unit 20 of each color includes a photosensitive drum 21 (photoconductor) that rotates in a direction indicated by an arrow A in FIG. 8, and a charger 22 that charges the photosensitive drum 21. Further, the toner image forming unit 20 of each color includes an exposure device 23 that exposes the photosensitive drum 21 charged by the charger 22 to light to form an electrostatic latent image on the photosensitive drum 21, and a developing device 24 that uses toner to develop the electrostatic latent image, which is formed on the photosensitive drum 21 by the exposure device 23, so as to form a toner image.

-Transfer Device 30-

The transfer device 30 has a function of primarily transferring toner images of the photosensitive drums 21 of the respective colors onto an intermediate transfer body in a superimposed manner, and secondarily transferring the superimposed toner images onto the sheet member P. Specifically, as illustrated in FIG. 9, the transfer device 30 includes a transfer belt 31 as the intermediate transfer body, a primary transfer roll 33, and a transfer unit 35.

The primary transfer roll 33 has a function of transferring a toner image formed on the photosensitive drum 21 to the transfer belt 31 at a primary transfer position T (see FIG. 8) between the photosensitive drum 21 and the primary transfer roll 33.

The transfer belt 31 has an endless shape, and is wound around plural rolls 32 to determine a posture thereof. When at least one of the plural rolls 32 is driven to rotate, the transfer belt 31 rotates in a direction indicated by an arrow B, and conveys the primarily transferred toner image to a secondary transfer position NT to be described later.

The transfer unit 35 has a function of transferring the toner image, which is transferred onto the transfer belt 31, to the sheet member P. Specifically, the transfer unit 35 includes a secondary transfer unit 34 and a facing roll 36.

The facing roll 36 is disposed below the transfer belt 31 so as to face the transfer belt 31. The secondary transfer unit 34 is disposed on an inner side of the transfer belt 31 such that the transfer belt 31 is disposed between the secondary transfer unit 34 and the facing roll 36. Specifically, the secondary transfer unit 34 is configured with a corotron. In the transfer unit 35, the toner image transferred onto the transfer belt 31 is transferred onto the sheet member P passing through the secondary transfer position NT by a electrostatic force generated due to electricity-discharge of the secondary transfer unit 34. Here, the secondary transfer position NT is a position where the transfer belt 31 and the facing roll 36 are in contact with each other.

[Conveying Mechanism 60]

The conveying mechanism 60 has a function of conveying the sheet member P accommodated in the accommodating portion 50 to the secondary transfer position NT. Further, the conveying mechanism 60 has a function of conveying the sheet member P from the secondary transfer position NT to the main heating unit 120 to be described later. The conveying mechanism 60 will be described in detail later.

[Reversing Mechanism 80]

The reversing mechanism 80 has a function of reversing the front and back of the sheet member P. The reversing mechanism 80 will be described in detail later.

[Fixing Device 100]

The fixing device 100 has a function of fixing the toner image, which is transferred onto the sheet member P by the transfer device 30, onto the sheet member P. The fixing device 100 will be described in detail later.

[Cooling Unit 90]

The cooling unit 90 has a function of cooling the sheet member P heated by the fixing device 100. As illustrated in FIG. 9, the cooling unit 90 is disposed downstream of the main heating unit 120 of the fixing device 100 in a conveyance direction of the sheet member P. The cooling unit 90 includes two cooling rolls 92 arranged in the device width direction. Since the two cooling rolls 92 have the same configuration, one of the cooling rolls 92 will be described.

Figure 7:
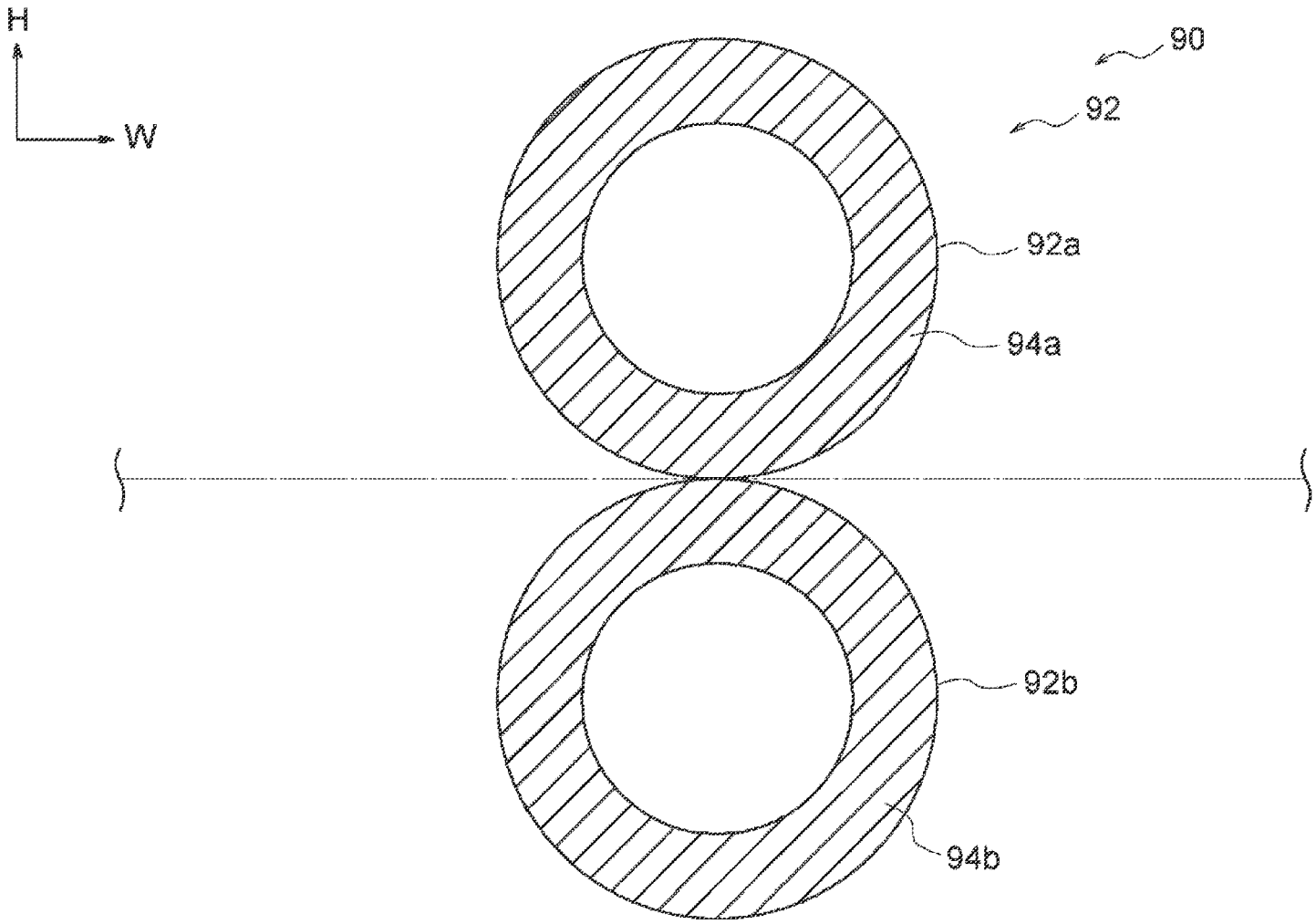
FIG. 7 is a cross-sectional view illustrating a cooling unit provided in the image forming device according to the exemplary embodiment.

As illustrated in FIG. 7, the cooling roll 92 includes a pair of rolls 92*a* and 92*b* that sandwich the sheet member P in a conveyance path thereof. The roll 92*a* is disposed above the conveyance path of the sheet member P. The roll 92*b* is disposed below the conveyance path of the sheet member P.

The rolls 92*a* and 92*b* have cylindrical base members 94*a* and 94*b* respectively that extend in the device depth direction. The base members 94*a* and 94*b* are, for example, aluminum tubes. An air blowing mechanism (not shown) is configured to generate an air flow inside the base members 94*a* and 94*b*. Due to the air flow, a temperature of surfaces of the rolls 92*a* and 92*b* is lower than a temperature thereof in a case where the air flow is not generated.

In this configuration, the roll 92*b* is rotated by a rotational force transmitted from a driving member (not shown). Further, the roll 92*a* is driven to rotate by the roll 92*b*. The rolls 92*a* and 92*b* convey the sheet member P while sandwiching the sheet member P therebetween, and cool the sheet member P.

(Operation of Image Forming Device)

In the image forming device 10 illustrated in FIG. 9, a toner image is formed as follows.

First, the charger 22 (see FIG. 8) of each color, to which a voltage is applied, uniformly charges a surface of the photosensitive drum 21 of each color at a predetermined negative potential. Subsequently, based on image data input from the outside, the exposure device 23 irradiates the charged surface of the photosensitive drum 21 of each color with exposure light to form an electrostatic latent image.

Accordingly, electrostatic latent images corresponding to the image data are formed on respective surfaces of the photosensitive drums 21. Further, developing devices 40 of the respective colors develop the electrostatic latent images to form toner images on the respective surfaces of the photosensitive drums 21 of the respective colors. The transfer device 30 transfers the toner images formed on the surfaces of the photosensitive drums 21 of the respective colors onto the transfer belt 31.

Meanwhile, the sheet member P is sent out from the accommodating portion 50 illustrated in FIG. 9 to the conveyance path of the sheet member P by the conveying mechanism 60 to be described later. The sheet member P being conveyed along the conveyance path is sent out to the secondary transfer position NT where the transfer belt 31 and the facing roll 36 are in contact with each other. At the secondary transfer position NT, the sheet member P is conveyed while being sandwiched between the transfer belt 31 and the facing roll 36, and accordingly the toner images on a front surface of the transfer belt 31 are transferred onto a first surface (=front surface) of the sheet member P.

Further, the fixing device 100 fixes the toner images, which are transferred onto the first surface of the sheet member P, onto the sheet member P, and the sheet member P is conveyed to the cooling unit 90. The cooling unit 90 cools the sheet member P onto which the toner images are fixed, and discharges the sheet member P to the discharge portion 52.

On the other hand, in a case of forming a toner image on a second surface (=back surface) of the sheet member P, the sheet member P that passes through the fixing device 100 by being conveyed by the conveying mechanism 60 is conveyed to the reversing mechanism 80. The sheet member P conveyed to the reversing mechanism 80 has the front and back thereof reversed by a reversing device 84. Conveying rolls 86 convey the sheet member P, whose front and back are reversed, to the conveying mechanism 60. In order to form a toner image on the second surface of the sheet member P, conveyance of the sheet member P to the secondary transfer position NT, transfer of the toner image onto the second surface of the sheet member, and fixing of the toner image onto the second surface are performed in the same manner as described above.

(Configuration of Main Part)

Next, the conveying mechanism 60, the reversing mechanism 80, and the fixing device 100 will be described.

[Conveying Mechanism 60]

As illustrated in FIG. 9, the conveying mechanism 60 includes a sending-out roll 62, plural conveying rolls 64, and a chain gripper 66. The conveying mechanism 60 is an example of a conveying unit.

Figure 6:
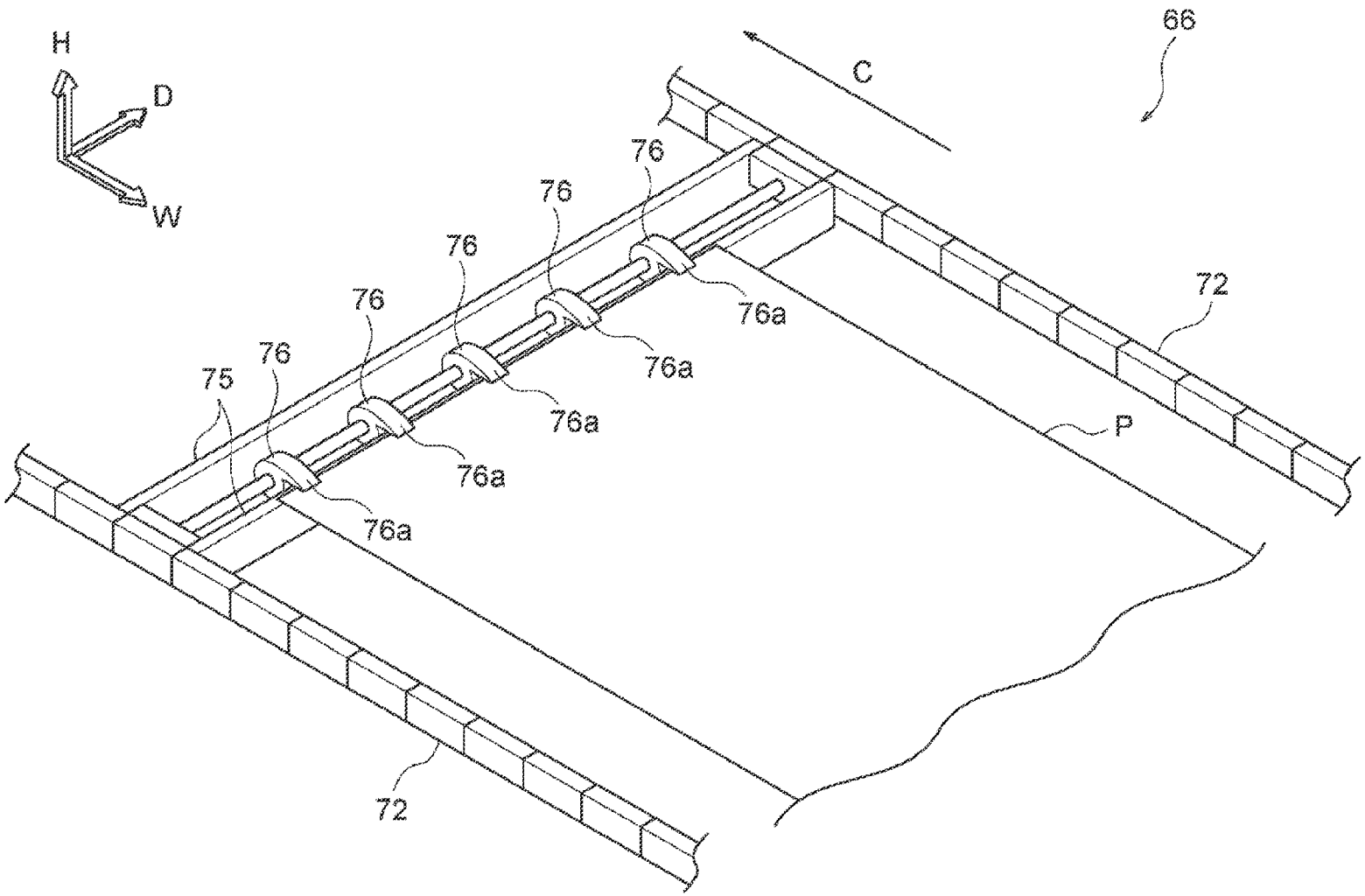
FIG. 6 is a perspective view illustrating a conveying mechanism provided in the image forming device according to the exemplary embodiment.

The sending-out roll 62 is a roll that sends out the sheet member P accommodated in the accommodating portion 50. The plural conveying rolls 64 include rolls that convey the sheet member P sent out by the sending-out roll 62 to the chain gripper 66, and rolls that convey the sheet member P conveyed by the chain gripper 66 to the cooling unit 90. The chain gripper 66 has a function of conveying the sheet member P while holding a leading end portion of the sheet member P. Specifically, as illustrated in FIG. 6, the chain gripper 66 has a pair of chains 72, and grippers 76 serving as holding portions (=gripping portions).

The pair of chains 72 is formed in an annular shape. The chains 72 in a pair are disposed at an interval in the device depth direction. The pair of chains 72 is wound around a pair of sprockets (not shown) disposed at both ends in an axial direction of the facing roll 36 (see FIG. 9), a pair of sprockets 71 (see FIG. 4) disposed at both ends in an axial direction of a pressing roll 140 to be described later, and a pair of sprockets 74 (see FIG. 9). When one pair of the sprockets rotates, the chain 72 rotates in a direction indicated by an arrow C.

Plural attachment members 75 extend between the pair of chains 72 along the device depth direction, at predetermined intervals along a circumferential direction (rotational direction) of the chains 72. The grippers 76 are attached.

Plural grippers 76 are attached to each attachment member 75 at predetermined intervals along the device depth direction. Each gripper 76 has a function of holding a leading end portion of the sheet member P. Specifically, each gripper 76 has a claw 76*a*. In addition, the attachment member 75 is formed with a contact portion 75*a* (see FIG. 5) with which the claw 76*a* comes into contact.

When the leading end portion of the sheet member P is sandwiched between the claw 76*a* of the gripper 76 and the contact portion 75*a* of the attachment member 75, the sheet member P gets held. For example, the claw 76*a* of the gripper 76 is pressed against the contact portion 75*a* of the attachment member 75 by a spring or the like, and the claw 76*a* is brought into contact with or separated from the contact portion 75*a* by an action of a cam or the like.

In the chain gripper 66, the chain 72 rotates in the direction indicated by the arrow C in a state where the leading end portion of the sheet member P is held between the gripper 76 and the attachment member 75, thereby conveying the sheet member P. The chain gripper 66 conveys the sheet member P conveyed by the plural conveying rolls 64 to the secondary transfer position NT, and further conveys the sheet member P to the main heating unit 120 described later after passing the sheet member P through a preheating unit 102 described later. A part of the conveyance path in the conveying mechanism 60 along which the sheet member P is conveyed is indicated by a one-dot chain line in FIG. 9.

In this configuration, at least from the secondary transfer position NT to the main heating unit 120, the conveying mechanism 60 conveys the sheet member P with both sheet surfaces (=recording surfaces) thereof facing in the vertical direction. In other words, at least from the secondary transfer position NT to the main heating unit 120, the conveying mechanism 60 conveys the sheet member P with a surface having an unfixed toner image being directed upward.

Further, there is case where toner images are formed on the first surface (=front surface) and the second surface (=back surface) of the sheet member P. Hereinafter, this is referred to as "the case of double-sided printing". In this case, when the sheet member P having an image transferred onto the second surface thereof is heated by the preheating unit 102 to be described later, the conveying mechanism 60 conveys the sheet member P with an image forming region of the first surface of the sheet member P in a state of not being in contact with other members. In other words, arrangement of other members is determined in consideration of a conveyance posture of the sheet member P being conveyed by the conveying mechanism 60. The "image forming region" refers to a portion other than an outer peripheral portion of the sheet member P where an image cannot be formed, and is a region where an image is formed when a solid image is formed on the sheet member P.

[Reversing Mechanism 80]

As illustrated in FIG. 9, the reversing mechanism 80 includes plural conveying rolls 82, the reversing device 84, and plural conveying rolls 86. The reversing mechanism 80 is an example of a reversing unit.

The plural conveying rolls 82 convey the sheet member P sent from the fixing device 100 to the reversing device 84. The reversing device 84 is, for example, a device that conveys the sheet member P while rotating the sheet member P plural times such that the conveyance direction of the sheet member P changes by, for example, 90 degrees each time, thereby twisting the sheet member P like a mevius band to reverse the front and back of the sheet member P. The plural conveying rolls 86 are rolls that convey the sheet member P whose front and back are reversed by the reversing device 84 to the chain gripper 66.

In this configuration, in the case of double-sided printing, the reversing mechanism 80 reverses the front and back of the sheet member P having the toner image fixed onto the first surface thereof. Then, the reversing mechanism 80 sends the sheet member P again to the secondary transfer position NT through the conveying mechanism 60.

[Fixing Device 100]

As illustrated in FIG. 1, the fixing device 100 includes the preheating unit 102 that heats the sheet member P being conveyed in a state of not being in contact with the sheet member P, the main heating unit 120 that comes into contact with the sheet member P to heat and press the sheet member P, and a blowing unit 170.

[Preheating Unit 102]

As illustrated in FIG. 1, the preheating unit 102 is disposed downstream of the secondary transfer position NT (see FIG. 9) in the conveyance direction of the sheet member P and above the conveyance path of the sheet member P. In other words, the preheating unit 102 is disposed on a side of the unfixed toner image transferred onto the sheet member P. That is, the preheating unit 102 is provided on the same side as the transfer unit 35 with respect to the conveyance path of the sheet member P. The preheating unit 102 includes a reflecting plate 104, plural infrared heaters 106 (hereinafter referred to as "heaters 106"), and a wire mesh 112.

-Reflecting Plate 104-

The reflecting plate 104 is formed of an aluminum plate, and has a shallow bottomed box shape opened on a side of the sheet member P being conveyed. In the present exemplary embodiment, as viewed from above, the reflecting plate 104 covers, in the device depth direction, the sheet member P being conveyed.

-Heater 106-

The heater 106 has a cylindrical shape extending in the device depth direction, and plural heaters 106 are accommodated inside the box-shaped the reflecting plate 104. In the present exemplary embodiment, as viewed from above, the heaters 106 cover, in the device depth direction, the sheet member P being conveyed. Each heater 106 is separated from the conveyance path of the sheet member P by 30 mm in an upward direction.

The plural heaters 106 are arranged at intervals in the device width direction. In the present exemplary embodiment, as viewed from above, a region where the plural heaters 106 are arranged covers, in the device width direction, one sheet member P being conveyed. In other words, the plural heaters 106 heat at one time the entire sheet member P being conveyed.

In the above configuration, from the heater 106, an infrared ray having a maximum spectral radiance at a wavelength of 3 μm or more and 5 μm or less is emitted. A surface temperature of the heater 106 is a predetermined temperature of 300° C. or higher and 1175° C. or lower.

-Wire Mesh 112-

The wire mesh 112 is fixed to an edge portion of an opening of the box-shaped reflecting plate 104 by a fixing member (not shown), and partitions the inside of the box-shaped reflecting plate 104 from the outside of the reflecting plate 104. Accordingly, the wire mesh 112 prevents the sheet member P being conveyed from coming into contact with the heater 106 inside the box-shaped reflecting plate 104.

In this configuration, the preheating unit 102 heats the sheet member P in a non-contact state from the unfixed toner image side. In other words, the preheating unit 102 functions as a softening unit that softens an unfixed toner.

Further, in a case of single-sided printing, when heating the sheet member P having the toner image transferred onto the first surface thereof, the preheating unit 102 heats the sheet member P so that a temperature of the first surface of the sheet member P is equal to or higher than a softening point of the toner or close to the softening point before the sheet member P is heated by the main heating unit 120.

In the case of double-sided printing, when heating the sheet member P having the toner image transferred onto the second surface thereof, the preheating unit 102 heats the sheet member P so that the temperature of the first surface of the sheet member P is lower than the softening point of the toner before the sheet member P is heated by the main heating unit 120.

Here, the "temperature of the first surface of the sheet member P before the sheet member P being heated by the main heating unit 120" is, as will be described later, the temperature of the first surface of the sheet member P at a position S01 separated from an upstream end of a nip portion N of the main heating unit 120 in the conveyance direction toward an upstream side in the conveyance direction by 100 mm. That is, when facing the second surface to heat the toner image transferred onto the second surface, the preheating unit 102 heats the sheet member P such that the temperature of the first surface at the position S01 is lower than the softening point of the toner. In other words, an output of the preheating unit 102 is adjusted such that the temperature of the first surface at the position S01 is lower than the softening point of the toner. Specifically, even when the toner image transferred onto the second surface is a black solid image, the output of the preheating unit 102 is adjusted such that the temperature of the first surface at the position S01 is lower than the softening point of the toner.

In the present exemplary embodiment, as an example, an output condition of the preheating unit 102 under which the temperature of the first surface of the sheet member P is lower than the softening point of the toner is obtained in advance for each paper type or size by a test, and an output table of the preheating unit 102 is stored in the control unit 160. Then, the control unit 160 adjusts the output of the preheating unit 102 based on information of the paper type or size input by a user. Accordingly, the preheating unit 102 heats the sheet member P such that the temperature of the first surface of the sheet member P is lower than the softening point of the toner. The temperature of the first surface at the position S01 may be measured by a temperature sensor, and the control unit 160 may adjust the output of the preheating unit 102 based on a measurement result, thereby heating the sheet member P such that the temperature of the first surface of the sheet member P is lower than the softening point of the toner.

Here, "the softening point of the toner (=glass transition temperature of the toner)" is a ½ descent rate measured under conditions of a die pore diameter of 0.5 mm, a pressure load of 0.98 MPa, and a temperature increase rate of 1° C./min in a temperature increase test using a flow tester (CFT500, manufactured by Shimadzu Corporation). Note that the ½ descent rate is a temperature corresponding to ½ of a height obtained from an outflow start point to an end point when a toner sample is melted and flowed out.

[Blowing Unit 170]

As illustrated in FIG. 1, the blowing unit 170 is disposed so as to face the preheating unit 102 in the vertical direction, and the sheet member P being conveyed passes between the blowing unit 170 and the preheating unit 102. The blowing unit 170 includes plural fans 172 arranged in the device width direction and the device depth direction. The fan 172 is an example of a blowing unit.

In this configuration, when the plural fans 172 blow air toward the sheet member P passing between the blowing unit 170 and the preheating unit 102, the conveyance posture of the sheet member P conveyed with the leading end portion thereof being held is stabilized. The fan 172 is an example of a stabilizing unit.

Here, "the conveyance posture of the sheet member P is stabilized" means that a distance from a rear end portion of the sheet member in a state of being bent by gravity to the preheating unit 102 is smaller than when the stabilizing unit is not provided. A distance from the sheet surface of the sheet member P to the preheating unit 102 may be longer than a distance from the preheating unit 102 to the gripper 76 and variation in the distance to the preheating unit 102 depending on a position of the sheet surface may be suppressed. In other words, the distance from the sheet surface of the sheet member P to the preheating unit 102 may be longer than the distance from the preheating unit 102 to the gripper 76, and a difference between a longest distance from the sheet surface of the sheet member P to the preheating unit 102 and a shortest distance may be reduced. Here, an output of the fan 172 may be adjusted. In the present exemplary embodiment, as an example, an output condition of the fan 172 is obtained for each paper type or size, and an output table of the fan 172 is stored in the control unit 160. Then, the control unit 160 adjusts the output of the fan 172 based on the information of the paper type or size input by the user. For example, when a paper thickness input by the user is larger than a predetermined value or a size is larger than a predetermined value, the output of the fan is increased. The distance from the sheet surface of the sheet member P to the preheating unit 102 may be measured by an optical sensor, and the control unit 160 may adjust the output of the fan 172 based on a measurement result thereof.

Further, when the plural fans 172 blow air toward the sheet member P, the temperature of the sheet surface of the sheet member P on a side to which the air is blown decreases. In this way, the fan 172 functions as a temperature reducing unit.

[Main Heating Unit 120]

As illustrated in FIG. 1, the main heating unit 120 is disposed downstream of the preheating unit 102 in the conveyance direction of the sheet member P. The main heating unit 120 includes a heating roll 130 that comes into contact with the sheet member P being conveyed to heat the sheet member P, a pressing roll 140 that presses the sheet member P toward the heating roll 130, and a driven roll 150 that is driven to rotate by the rotating heating roll 130.

-Heating Roll 130-

As illustrated in FIG. 1, the heating roll 130 is disposed so as to come into contact with a surface facing upward of the sheet member P being conveyed and extend in the device depth direction with an axial direction thereof serving as the device depth direction. The heating roll 130 includes a cylindrical base member 132, a rubber layer 134 formed so as to cover an entire circumference of the base member 132, a release layer 136 formed so as to cover an entire circumference of the rubber layer 134, and a heater 138 accommodated in the base member 132. An outer diameter of an outer circumferential surface of the release layer 136 of the heating roll 130 is, for example, 80 mm.

The base member 132 is an aluminum tube and has a thickness of 20 mm, for example. The rubber layer 134 is made of silicone rubber, and has a thickness of 6 mm, for example. Further, the release layer 136 is made of a copolymer of tetrafluoroethylene and perfluoroethylene (PFA resin), and has a thickness of 50 μm, for example.

Figure 4:
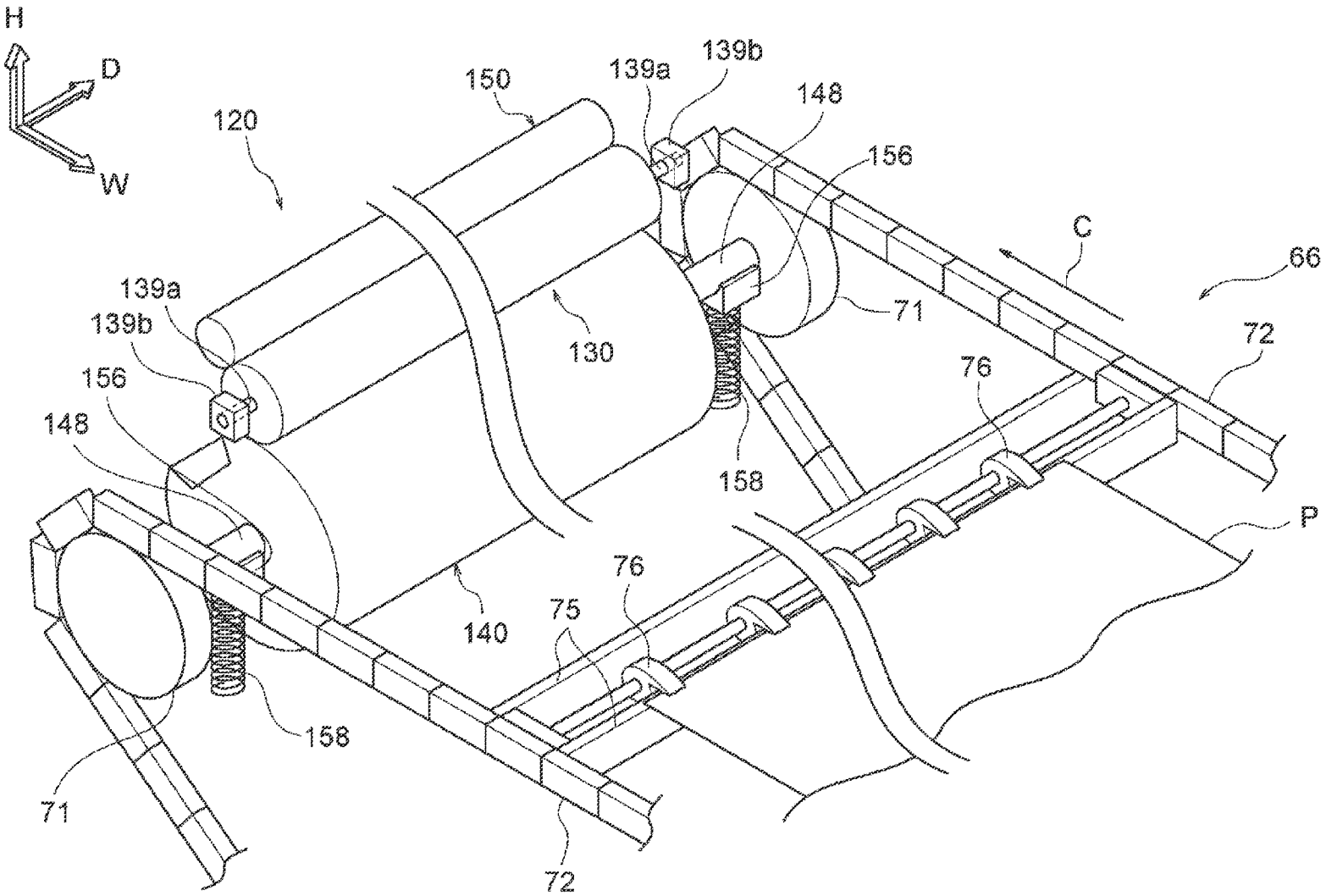
FIG. 4 is a perspective view illustrating the main fixing portion of the fixing device provided in the image forming device according to the exemplary embodiment.

As illustrated in FIG. 4, shaft portions 139*a* extending in the device depth direction are formed at both end portions of the heating roll 130 respectively in the device depth direction. Each shaft portion 139*a* is supported by a support member 139*b*. The heating roll 130 is rotatably supported by support members 139*b* at both end portions of the heating roll 130.

-Driven Roll 150-

As illustrated in FIGS. 1 and 4, the driven roll 150 is disposed so as to extend in the device depth direction with an axial direction thereof serving as the device depth direction, on an opposite side of the heating roll 130 than the sheet member P being conveyed. The driven roll 150 includes a cylindrical base member 152 and a heater 154 accommodated in the base member 152. An outer diameter of an outer circumferential surface of the base member 152 of the driven roll 150 is, for example, 50 mm.

The base member 152 is an aluminum tube and has a thickness of 10 mm, for example. The driven roll 150 is rotatably supported by a support member (not shown) at both end portions of the driven roll 150.

In this configuration, the driven roll 150 is driven to rotate by the heating roll 130. The driven roll 150 heats the heating roll 130. As described above, since the heating roll 130 is heated by the driven roll 150 and the heating roll 130 itself has the heater 138, a surface temperature of the heating roll 130 becomes a predetermined temperature of 180° C. or higher and 200° C. or lower.

-Pressing Roll 140-

As illustrated in FIGS. 1 and 4, the pressing roll 140 is provided on an opposite side of the sheet member P being conveyed than the heating roll 130, and is disposed so as to be in contact with a surface facing downward of the sheet member P being conveyed and extend in the device depth direction with an axial direction thereof serving as the device depth direction. The pressing roll 140 includes a cylindrical base member 142, a rubber layer 144 formed so as to cover the base member 142, a release layer 146 formed so as to cover the rubber layer 144, and a pair of shaft portions 148 (see FIG. 4) formed at both end portions in the device depth direction. An outer diameter of an outer circumferential surface of the release layer 146 of the pressing roll 140 is, for example, 225 mm. Thus, an outer diameter of the pressing roll 140 is larger than an outer diameter of the heating roll.

The base member 142 is an aluminum tube and has a thickness of 20 mm, for example. The rubber layer 144 is made of silicone rubber and has a thickness of 1 mm, for example. Further, the release layer 146 is made of a copolymer of tetrafluoroethylene and perfluoroethylene (PFA resin), and has a thickness of 50 μm, for example.

Figure 5:
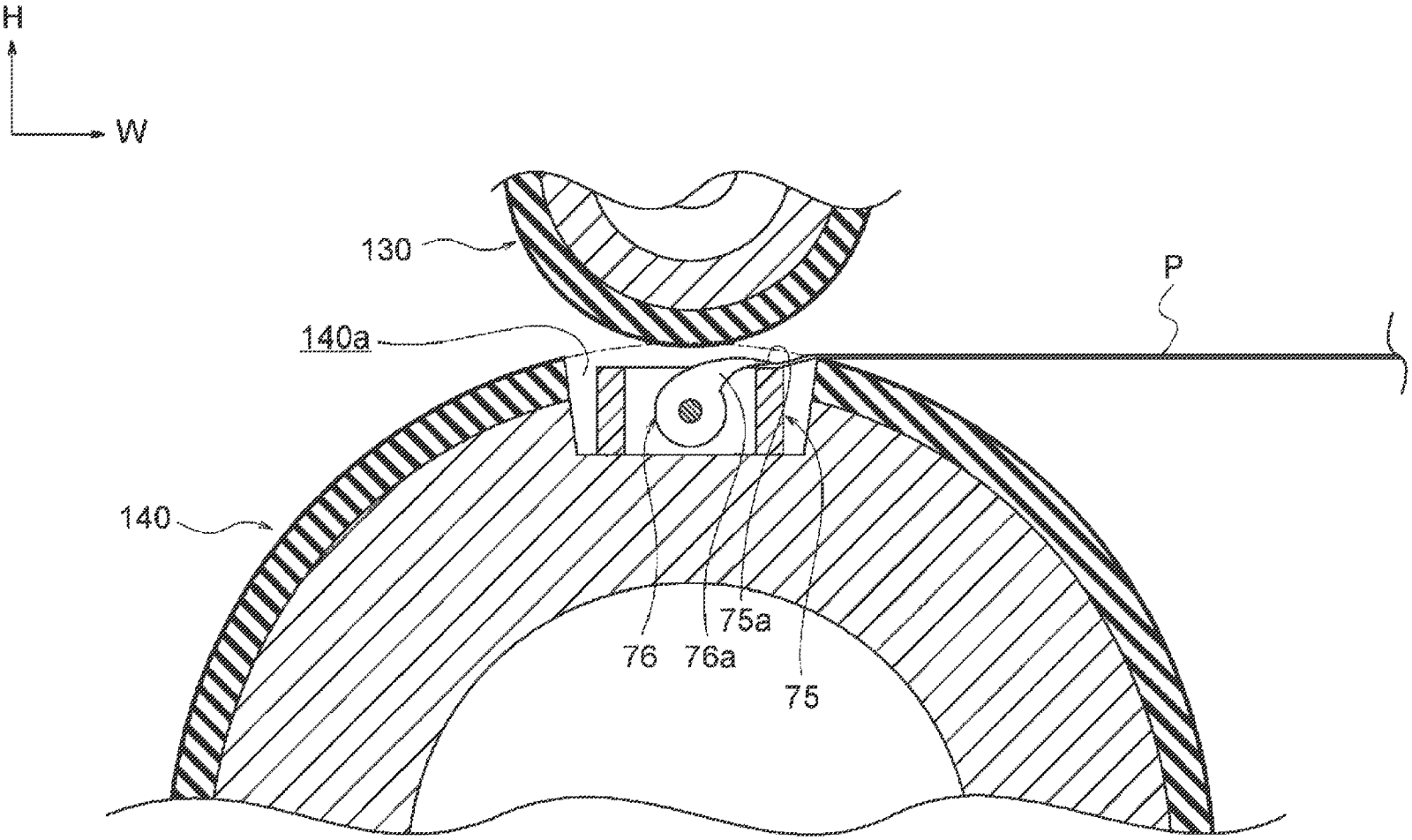
FIG. 5 is a cross-sectional view illustrating the main fixing portion of the fixing device provided in the image forming device according to the exemplary embodiment.

A recessed portion 140*a* extending in the device depth direction is formed in an outer circumferential surface of the pressing roll 140. As illustrated in FIG. 5, when the sheet member P passes between the pressing roll 140 and the heating roll 130, the gripper 76 that grips the leading end portion of the sheet member P is accommodated in the recessed portion 140*a*.

As illustrated in FIG. 4, the pair of shaft portions 148 are formed at both end portions of the pressing roll 140 in the device depth direction, have a diameter smaller than that of the outer circumferential surface of the release layer 146 of the pressing roll 140, and extend in the axial direction.

In this configuration, the pressing roll 140 is rotated by a rotational force transmitted from a driving member (not shown). Further, the heating roll 130 is driven to rotate by the rotating pressing roll 140, and the driven roll 150 is driven to rotate by the rotating heating roll 130. When conveying the sheet member P while sandwiching the sheet member P onto which the toner image is transferred, the heating roll 130 and the pressing roll 140 fix the toner image onto the sheet member P.

-Others-

As illustrated in FIG. 4, the main heating unit 120 includes a support member 156 that supports the pressing roll 140, and a biasing member 158 that biases the pressing roll 140 toward the heating roll 130 side via the support member 156.

A pair of support members 156 is disposed so as to rotatably support the pair of shaft portions 148 of the pressing roll 140 from below.

Biasing members 158 in a pair are compression springs, and are disposed on an opposite side of the support members 156 than the shaft portions 148.

Figure 2:
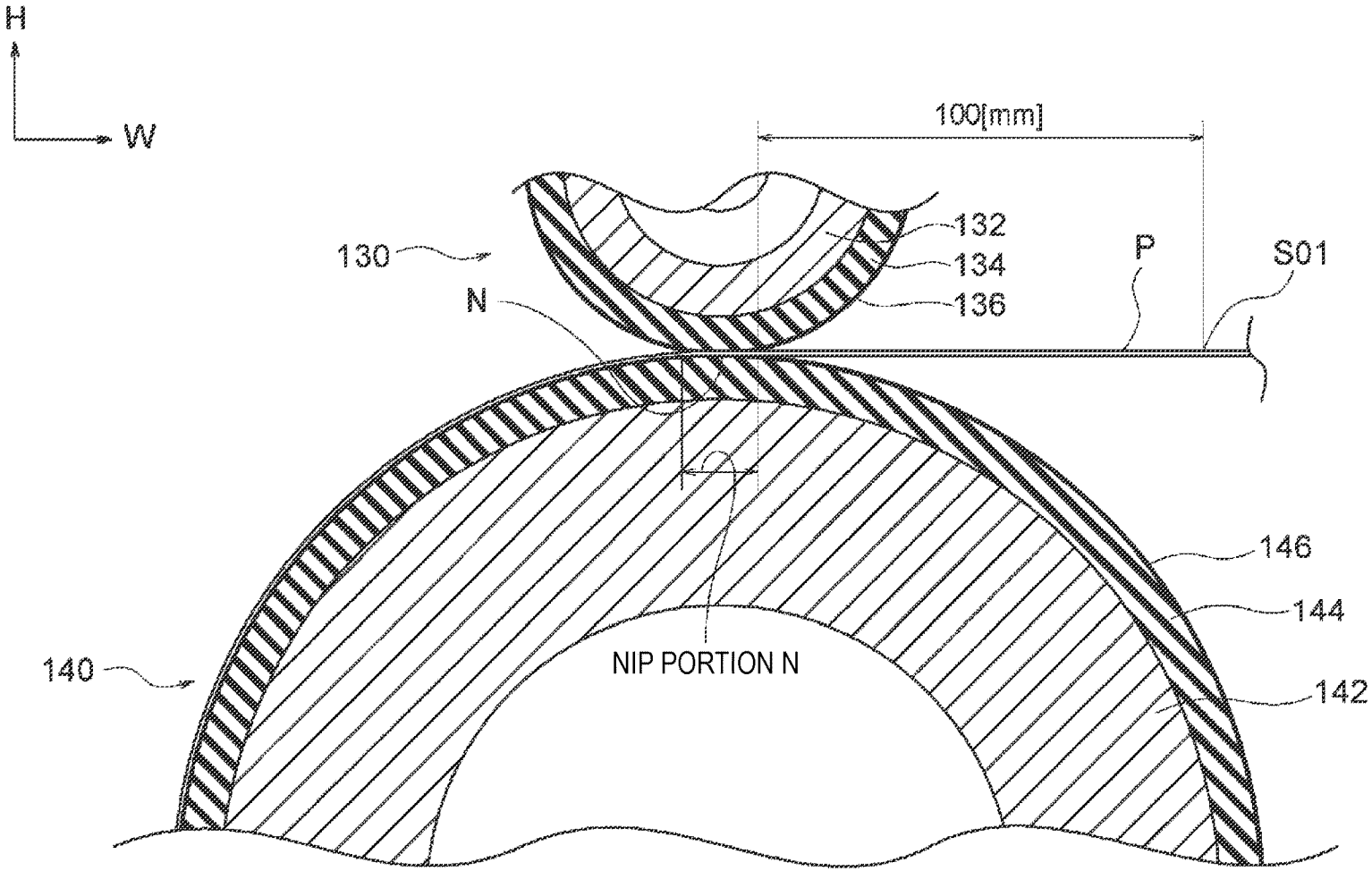
FIG. 2 is a cross-sectional view illustrating a main fixing portion of the fixing device provided in the image forming device according to the exemplary embodiment.

In this configuration, the pair of biasing members 158 bias the pressing roll 140 toward the heating roll 130 side, so that the pressing roll 140 presses the sheet member P toward the heating roll 130. Then, as illustrated in FIG. 2, a portion of the heating roll 130 that is biased by the pressing roll 140 is deformed, and the nip portion N that is a region where the heating roll 130 and the pressing roll 140 are in contact with each other is formed.

(Operation of Configuration of Main Part)

Next, an operation of the image forming device 10 will be described in comparison with an image forming device 510 according to a comparative embodiment. First, with respect to a configuration of the image forming device 510 according to the comparative embodiment, portions different from those of the image forming device 10 will be described mainly. Note that with respect to an operation of the image forming device 510, portions different from those of the image forming device 10 will also be described mainly.

[Image Forming Device 510]

Figure 10:
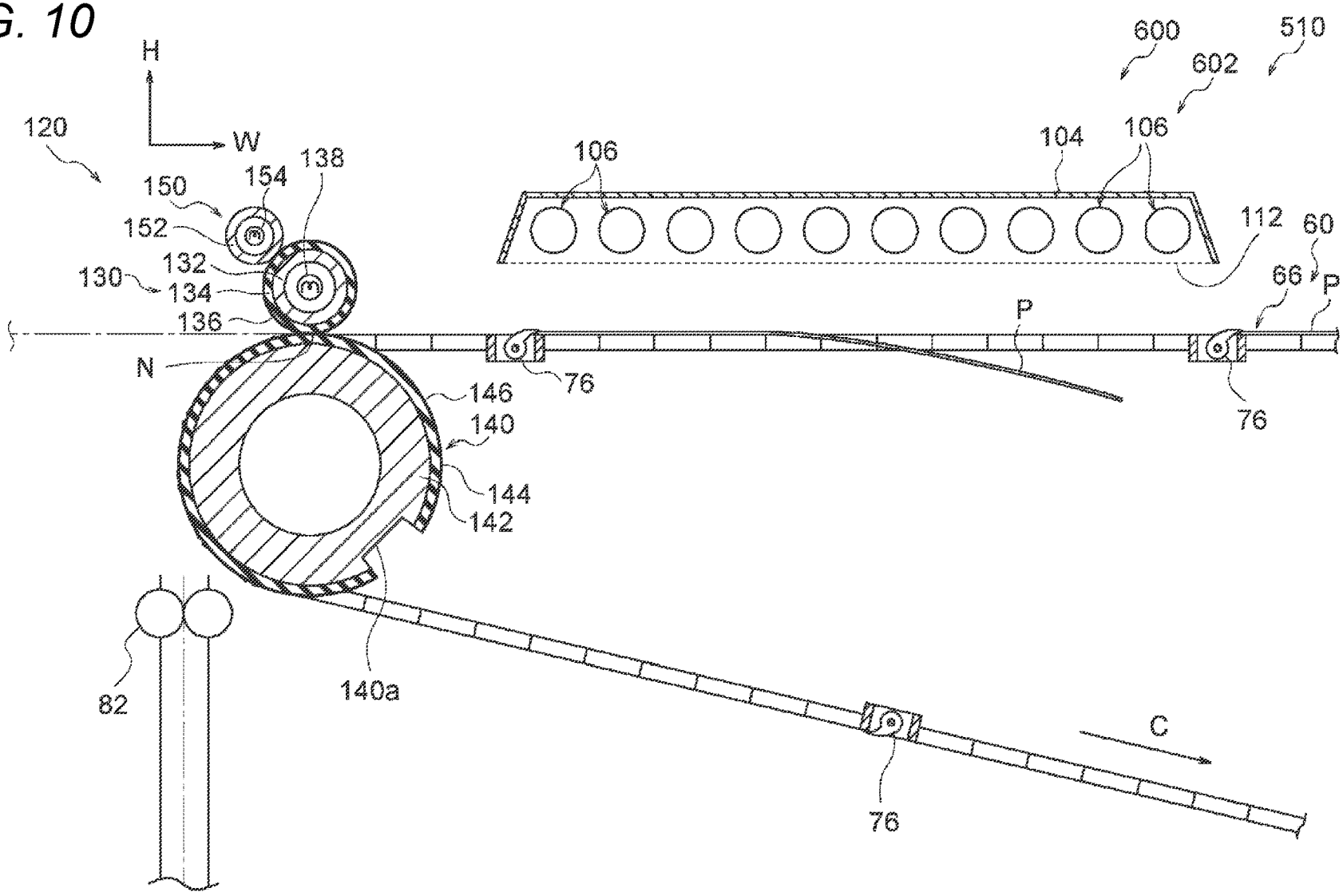
FIG. 10 is a configuration diagram illustrating a fixing device provided in an image forming device according to a comparative embodiment.

The image forming device 510 includes the accommodating portion 50, the discharge portion 52, the image forming unit 12, the conveying mechanism 60, the reversing mechanism 80, a fixing device 600, and the cooling unit 90. As illustrated in FIG. 10, the fixing device 600 includes a preheating unit 602 that heats the sheet member P being conveyed in a state of not being in contact with the sheet member P, and the main heating unit 120.

In this configuration, the preheating unit 602 heats the sheet member P in a non-contact state from an unfixed toner image side. In the case of double-sided printing, before the main heating unit 120 heats the sheet member P, the temperature of the first surface of the sheet member P is equal to or higher than the softening point of the toner since the preheating unit 602 heats the sheet member P having a toner image transferred onto the second surface thereof.

(Operation of Image Forming Devices 10, 510)

In the image forming device 10 illustrated in FIG. 9, the conveying mechanism 60 conveys the sheet member P to the secondary transfer position NT, and at the secondary transfer position NT, the transfer belt 31 and the facing roll 36 convey the sheet member P while sandwiching the sheet member P. Accordingly, a toner image on a front surface of the transfer belt 31 is transferred onto the first surface (=front surface) of the sheet member P.

Thereafter, while the conveying mechanism 60 conveys the sheet member P with both sheet surfaces thereof facing in the vertical direction, the preheating units 102 and 602 illustrated in FIGS. 1 and 10 heat the sheet member P in a non-contact state from the first surface side (=unfixed toner image side) of the sheet member P being conveyed by the conveying mechanism 60. When the preheating unit 102 illustrated in FIG. 1 heats the sheet member P, the fan 172 blows air toward the second surface (=back surface) of the sheet member P. Accordingly, the conveyance posture of the sheet member P in a state of being heated by the preheating unit 102 is stabilized.

Further, the main heating units 120 illustrated in FIGS. 1 and 10 fix the toner image onto the first surface of the sheet member P when the sheet member P is conveyed in a sandwiched manner by the heating roll 130 and the pressing roll 140. In addition, the reversing mechanism 80 receives the sheet member P having the toner image fixed onto the first surface thereof from the main heating unit 120, conveys the sheet member P, and reverses the front and back of the sheet member P. Further, the conveying mechanism 60 receives the sheet member P whose front and back are reversed from the reversing mechanism 80 and conveys the sheet member P.

The conveying mechanism 60 conveys the sheet member P again to the secondary transfer position NT, and at the secondary transfer position NT, the transfer belt 31 and the facing roll 36 convey the sheet member P while sandwiching the sheet member P. Accordingly, a toner image on the front surface of the transfer belt 31 is transferred onto the second surface (=back surface) of the sheet member P.

Thereafter, while the conveying mechanism 60 conveys the sheet member P with both sheet surfaces thereof facing in the vertical direction, the preheating units 102 and 602 heat the sheet member P in a non-contact state from the second surface side (=unfixed toner image side) of the sheet member P being conveyed by the conveying mechanism 60. When the preheating unit 102 illustrated in FIG. 1 heats the sheet member P, the fan 172 of the blowing unit 170 blows air toward the first surface (=front surface) of the sheet member P. Accordingly, a posture of the sheet member P in a state of being heated by the preheating units 102 and 602 is stabilized.

When the preheating units 102 and 602 heat the sheet member P having the image transferred onto the second surface thereof, the conveying mechanism 60 conveys the sheet member P with an image forming region on the first surface of the sheet member P in a state of not being in contact with other members.

Further, the main heating unit 120 fixes the toner image onto the second surface of the sheet member P when the sheet member P is conveyed in a sandwiched manner by the heating roll 130 and the pressing roll 140. In this way, the toner image on the first surface is sandwiched twice by the heating roll 130 and the pressing roll 140. In addition, the cooling unit 90 cools the sheet member P having the toner images fixed onto both surfaces thereof, and discharges the sheet member P to the discharge portion 52.

Here, before the main heating unit 120 heats the sheet member P, the temperature of the first surface of the sheet member P becomes equal to or higher than the softening point of the toner since the sheet member P having the toner image transferred onto the second surface thereof is heated by the preheating unit 602 illustrated in FIG. 10. In other words, since the preheating unit 602 heats the sheet member P having the toner image transferred onto the second surface thereof, the temperature of the first surface at the position S01 illustrated in FIG. 2 becomes equal to or higher than the softening point of the toner. As described above, when the temperature of the first surface at the position S01 is equal to or higher than the softening point of the toner, the sheet member P is heated by the main heating unit 120 in a state where the temperature of the first surface is equal to or higher than the softening point of the toner.

In contrast, when heating the sheet member P having the toner image transferred onto the second surface thereof, the preheating unit 102 illustrated in FIG. 1 heats the sheet member P so that the temperature of the first surface of the sheet member P is lower than the softening point of the toner before the sheet member P is heated by the main heating unit 120. In other words, when heating the toner image transferred onto the second surface, the preheating unit 102 heats the sheet member P such that the temperature of the first surface at the position S01 illustrated in FIG. 2 is lower than the softening point of the toner. As described above, since the temperature of the first surface at the position S01 is lower than the softening point of the toner, the sheet member P is heated by the main heating unit 120 in a state where the temperature of the first surface is lower than the softening point of the toner.

-Evaluation of Glossiness-

Next, since the glossiness (=gloss) of the toner images output by the image forming devices 10 and 510 is evaluated, this evaluation will be described. Specifically, toner images were formed on both surfaces of the sheet member P, and a difference between the glossiness of the first surface and the glossiness of the second surface was evaluated. In this evaluation, a toner having a softening point temperature of 75° C. was used.

1. Evaluation Specifications (see FIG. 3)

(a) In Example 1, the preheating unit 102 heated, from a second surface side, the sheet member P having a toner image transferred onto a second surface thereof such that a temperature of a first surface thereof at the position S01 was 60° C. and a temperature of the second surface was 65° C.

(b) In Example 2, the preheating unit 102 heated, from a second surface side, the sheet member P having a toner image transferred onto a second surface thereof such that a temperature of a first surface thereof at the position S01 was 65° C. and a temperature of the second surface was 70° C.

(c) In Example 3, the preheating unit 102 heated, from a second surface side, the sheet member P having a toner image transferred onto a second surface thereof such that a temperature of a first surface thereof at the position S01 was 70° C. and a temperature of the second surface was 75° C.

(d) In Comparative Example 1, the preheating unit 602 heated, from a second surface side, the sheet member P having a toner image transferred onto a second surface thereof such that a temperature of a first surface thereof at the position S01 was 80° C. and a temperature of the second surface thereof was 85° C.

(e) In Comparative Example 2, the preheating unit 602 heated, from a second surface side, the sheet member P having a toner image transferred onto a second surface thereof such that a temperature of a first surface thereof at the position S01 was 90° C. and a temperature of the second surface thereof was 95° C.

(f) In Comparative Example 3, the sheet member P having a toner image transferred onto a second surface thereof was heated by the preheating unit such that a temperature of a first surface thereof at the position S01 was 75° C. and a temperature of the second surface thereof was 70° C. In Comparative Example 3, differently from Examples 1 to 3 and Comparative Examples 1 and 2, the preheating unit heated, from a first surface side, the sheet member P having the toner image transferred onto the second surface thereof. That is, the preheating unit is disposed below the sheet member P being conveyed.

The details other than those described above were all similar to each other.

2. Evaluation Method

As the sheet member P, an OS coated paper of A4 size (manufactured by Fuji Xerox Co., Ltd., basis weight: 127.9 $g/m^2$) was used. Then, a black solid image (an image of 100% black area coverage) was formed on both surfaces of the sheet member P.

The surface temperature of the heating roll 130 was set to 200° C., and pressure at the nip portion N where the heating roll 130 and the pressing roll 140 were in contact with each other was set to 250 KPa.

3. Evaluation Items

The difference (=gloss difference) between the glossiness of the first surface and the glossiness of the second surface of the sheet member P, which was output, was evaluated. The glossiness was evaluated using a gloss meter (AG-4430 manufactured by BYK-Gardner). Specifically, this gloss meter was used to perform measurement at an incident angle of 60 degrees in a specular gloss measurement method (JIS Z 8741), and a measured value was defined as the glossiness.

4. Evaluation Criteria and Evaluation Results

When a difference between glossiness of a toner image on a first surface and glossiness of a toner image on a second surface is large even though the toner images are formed by the same image forming device, a user feels uncomfortable. In this evaluation, when the difference between the glossiness of the toner image on the first surface and the glossiness of the toner image on the second surface is 10 or less, it is considered that the user does not feel uncomfortable, and the evaluation is "good"; when the difference between the glossiness of the toner image on the first surface and the glossiness of the toner image on the second surface is larger than 10, the evaluation is "poor".

The evaluation results are shown in a table of FIG. 3. As shown in the table of FIG. 3, in Examples 1 to 3 in which the temperature of the first surface was lower than the softening point of the toner, the evaluation result was "good". In contrast, in Comparative Examples 1 to 3 in which the temperature of the first surface was equal to or higher than the softening point of the toner, the evaluation result was "poor".

5. Consideration

In the case of double-sided printing, the toner image on the first surface is sandwiched twice by the heating roll 130 and the pressing roll 140, and the toner image on the second surface is sandwiched once by the heating roll 130 and the pressing roll 140.

Here, in Comparative Examples 1 to 3, the temperature of the first surface at the position S01 is equal to or higher than the softening point of the toner. Therefore, when the toner image formed on the first surface is sandwiched by the heating roll 130 and the pressing roll 140 for the second time, surface roughness of a surface of the toner image is reduced than that in a case where the toner image is sandwiched only once, and the glossiness is improved.

On the other hand, in Examples 1 to 3, the temperature of the first surface at the position S01 is lower than the softening point of the toner. Therefore, when the toner image formed on the first surface is sandwiched by the heating roll 130 and the pressing roll 140 for the second time, the occurrence that the surface roughness of the surface of the toner image is reduced and the glossiness is improved is suppressed.

Therefore, as shown in the table of FIG. 3, in Comparative Examples 1 to 3, the difference between the glossiness of the first surface and the glossiness of the second surface was large, and the evaluation result was considered to be "poor". On the other hand, in Examples 1 to 3, the difference between the glossiness of the first surface and the glossiness of the second surface was small and the evaluation result was considered to be "good".

(Summary)

As described above, when heating the sheet member P having the toner image transferred onto the second surface thereof, the preheating unit 102 heats the sheet member P so that the temperature of the first surface of the sheet member P is lower than the softening point of the toner before the sheet member P is heated by the main heating unit 120. Therefore, as seen from the evaluation results described above, the difference between the glossiness of the toner image on the first surface and the glossiness of the toner image on the second surface is smaller than that in the case of using the image forming device 510 according to the comparative embodiment.

The preheating unit 102 heats the sheet member P in a non-contact state from the unfixed toner image side. That is, when heating the sheet member P having the toner image transferred onto the second surface thereof, the preheating unit 102 heats the sheet member P from the second surface side. Therefore, the temperature of the second surface of the sheet member P onto which the unfixed toner image is transferred is higher than the temperature of the first surface of the sheet member P onto which the toner image is fixed.

In addition, since the temperature of the second surface of the sheet member P onto which the unfixed toner image is transferred is higher than the temperature of the first surface, the glossiness of the toner image on the second surface is improved as compared with a case where the temperature of the second surface is lower than the temperature of the first surface.

When the sheet member P is to be heated by the preheating unit 102, the conveying mechanism 60 conveys the sheet member P with the sheet surface thereof facing in the vertical direction. Further, the preheating unit 102 heats the sheet member P from above the sheet member, and the fan 172 blows air to the sheet member P from below the sheet member P. As described above, when the sheet member P having the toner image transferred onto the second surface thereof is heated by the preheating unit 102, the fan 172 blows air to the sheet member P from the first surface side of the sheet member P. Therefore, the temperature of the first surface is easily lower than the softening point of the toner, as compared with a case where air on the first surface side is stagnant.

When the sheet member P is to be heated by the preheating unit 102, the conveying mechanism 60 conveys the sheet member P with the sheet surface thereof facing in the vertical direction. Further, the preheating unit 102 heats the sheet member P from above the sheet member, and the fan 172 blows air to the sheet member P from below the sheet member P. Therefore, the conveyance posture of the sheet member P being conveyed is stabilized as compared with a case where the sheet member P is conveyed in a state of being bent by gravity.

In addition, since the conveyance posture of the sheet member P is stabilized, a temperature of the rear end portion of the sheet member P is prevented from being lower than a temperature of the leading end portion of the sheet member P as compared with a case where the sheet member P is conveyed in a state of being bent by gravity.

When the preheating unit 102 heats the sheet member P having the image transferred onto the second surface thereof, the conveying mechanism 60 conveys the sheet member P with the image forming region on the first surface of the sheet member P in a state of not being in contact with other members. Therefore, as compared with a case where the image forming region on the first surface of the sheet member P is in contact with another member, occurrence of a difference in temperature in one sheet member P is suppressed, and thus a difference in glossiness of the toner image formed on the first surface of the sheet member P occurs.

When the sheet member P is to be heated by the preheating unit 102, the conveying mechanism 60 conveys the sheet member P with the sheet surface thereof facing in the vertical direction. In addition, the preheating unit 102 heats the sheet member P from above the sheet member. Therefore, as compared with a case where the conveying mechanism conveys the sheet member P with the sheet surface thereof being directed in a horizontal direction and the preheating unit heats the sheet member P from the horizontal direction, hot air generated by the preheating unit is suppressed from rising and escaping from between the sheet member P and the preheating unit.

In the above-described exemplary embodiment, the preheating unit 102 heats the sheet member P from the unfixed toner image side in a non-contact state, and alternatively, the preheating unit may heat the sheet member P in a state of being in contact with the sheet member P, for example. However, in this case, an effect obtained when the preheating unit 102 heats the sheet member P in a non-contact state is not obtained.

Although not particularly described in the above-described exemplary embodiment, a temperature detection member may be provided at the position S01, and the output of the preheating unit 102 may be adjusted based on a detection result thereof.

Although not particularly described in the above-described exemplary embodiment, a cooling member may be provided that cools the first surface of the sheet member P before the toner image is fixed onto the second surface by the main heating unit 120.

In the above-described exemplary embodiment, when the preheating unit 102 heats the sheet member P having the image transferred onto the second surface thereof, the conveying mechanism 60 conveys the sheet member P with the image forming region on the first surface of the sheet member P in a state of not being in contact with other members, and alternatively, the image forming region on the first surface may contact with other members. However, in this case, an effect produced by the non-contact state is not produced.

When the temperature of the first surface at the position S01 is lower than the softening point of the toner, the preheating unit 102 may cause the temperature of the second surface to be lower than the softening point of the toner, or to be equal to or higher than the softening point of the toner. However, in order to easily fix the toner onto the sheet member P with the main heating unit 120, the temperature of the second surface may be equal to or higher than the softening point of the toner.

It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device comprising:

a transfer unit that transfers a toner image onto a recording medium being conveyed;

a first heating unit that is arranged downstream of the transfer unit in a conveyance direction of the recording medium, comes into contact with the recording medium to heat the recording medium, and fixes the toner image onto the recording medium, the first heating unit comprising a first member and a second member;

a reversing unit that reverses front and back of the recording medium having a first toner image fixed onto a first surface of the recording medium by the first heating unit, and sends the recording medium to the transfer unit; and a second heating unit that is arranged between the transfer unit and the first heating unit in the conveyance direction of the recording medium and heats the recording medium having a second toner image transferred onto a second surface of the recording medium, wherein the second heating unit heats the recording medium so that a temperature of the first surface of the recording medium is lower than a softening point of a toner before the recording medium is heated by the first heating unit, and the first member includes a heater, and a heater is not provided with the second member, the second member contacting the first surface of the recording medium when the reversing unit reverses front and back of the recording medium and the recording medium having the second toner image transferred onto the second surface of the recording medium is heated by the first heating unit.

2. The image forming device according to claim 1, wherein the second heating unit heats the recording medium from a side of an unfixed toner image in a non-contact state.

3. The image forming device according to claim 2, wherein the recording medium is conveyed with a recording surface facing in a vertical direction when the second heating unit heats the recording medium having the second toner image transferred onto the second surface, the second heating unit heats a recording member from above the recording member, and a blowing unit that blows air to the recording medium is provided on an opposite side of the recording medium being conveyed than the second heating unit.

4. The image forming device according to claim 3, further comprising a conveying unit that grips a leading end portion of the recording medium and conveys the recording medium, wherein, when the second heating unit heats the recording medium having an image transferred onto the second surface, the conveying unit conveys the recording medium with an image forming region on the first surface of the recording medium being in a non-contact state with another member.

5. The image forming device according to claim 2, further comprising a conveying unit that grips a leading end portion of the recording medium and conveys the recording medium, wherein, when the second heating unit heats the recording medium having an image transferred onto the second surface, the conveying unit conveys the recording medium with an image forming region on the first surface of the recording medium being in a non-contact state with another member.

6. The image forming device according to claim 5, wherein the conveying unit conveys the recording medium with a recording surface facing in a vertical direction when the second heating unit heats the recording medium having the second toner image transferred onto the second surface, the second heating unit heats a recording medium from above the recording medium, and a stabilizer configured to stabilize a conveyance posture of the recording medium is arranged on a side opposite to the second heating unit on an opposite side of the recording medium being conveyed than the second heating unit in a non-contact state with the recording medium.

7. The image forming device according to claim 1, further comprising a conveying unit that grips a leading end portion of the recording medium and conveys the recording medium, wherein, when the second heating unit heats the recording medium having the second toner image transferred onto the second surface, the conveying unit conveys the recording medium with an image forming region on the first surface of the recording medium being in a non-contact state with another member.

8. The image forming device according to claim 7, wherein the conveying unit conveys the recording medium with a recording surface facing in a vertical direction when the second heating unit heats the recording medium having the second toner image transferred onto the second surface, the second heating unit heats the recording medium from above the recording medium, and a stabilizer configured to stabilize a conveyance posture of the recording medium is arranged on a side opposite to the second heating unit on an opposite side of the recording medium being conveyed than the second heating unit in a non-contact state with the recording medium.

* * * * *